US008051865B1

(12) United States Patent
Uranga

(10) Patent No.: US 8,051,865 B1
(45) Date of Patent: Nov. 8, 2011

(54) CANOPY FOR UMBRELLAS

(76) Inventor: Yvonne Uranga, Fullerton, CA (US)

( * ) Notice: Subject to any disclaimer, the term of this patent is extended or adjusted under 35 U.S.C. 154(b) by 0 days.

(21) Appl. No.: 13/087,656

(22) Filed: Apr. 15, 2011

Related U.S. Application Data

(60) Provisional application No. 61/324,674, filed on Apr. 15, 2010.

(51) Int. Cl.
*A45B 25/18* (2006.01)

(52) U.S. Cl. ..... 135/33.2; 135/33.41; 135/115

(58) Field of Classification Search ..... 135/114, 135/115, 33.2, 33.4, 33.41, 16, 97, 120.3
See application file for complete search history.

(56) References Cited

U.S. PATENT DOCUMENTS

| | | | | |
|---|---|---|---|---|
| 734,311 | A * | 7/1903 | Ferroussat | 135/16 |
| 2,746,469 | A * | 5/1956 | D Andrea | 135/33.41 |
| 3,464,431 | A | 9/1969 | Loeffler | |
| 4,274,429 | A | 6/1981 | Kinski | |
| 4,499,133 | A * | 2/1985 | Prince | 428/81 |
| 4,766,919 | A * | 8/1988 | Crates | 135/97 |
| 4,887,786 | A | 12/1989 | Stokes | |
| 5,002,080 | A | 3/1991 | Ma | |
| 5,080,123 | A * | 1/1992 | Stein | 135/97 |
| 5,222,513 | A * | 6/1993 | Hilliard | 135/97 |
| 5,263,505 | A | 11/1993 | Yeom | |
| 5,439,017 | A | 8/1995 | Brown | |
| 5,477,876 | A * | 12/1995 | Moss | 135/97 |
| 5,664,595 | A * | 9/1997 | Vonderhorst et al. | 135/16 |
| 5,927,310 | A | 7/1999 | Lin | |
| 5,947,138 | A | 9/1999 | DeAngelis | |
| 5,967,161 | A | 10/1999 | Neal | |
| 6,109,281 | A | 8/2000 | Lowenthal | |
| 6,155,278 | A | 12/2000 | Lin | |
| 6,698,440 | B2 | 3/2004 | Beyer et al. | |
| 6,910,490 | B1 | 6/2005 | Villa | |
| 7,101,000 | B2 | 9/2006 | DeMars | |
| 7,121,289 | B1 | 10/2006 | Anderson | |
| 7,425,046 | B2 | 9/2008 | DeMars | |
| 7,503,336 | B2 | 3/2009 | Labarbera | |
| 7,618,081 | B2 | 11/2009 | Rankin et al. | |
| 2002/0157696 | A1 | 10/2002 | O'Brien | |
| 2004/0020522 | A1 | 2/2004 | James | |
| 2004/0163692 | A1 | 8/2004 | Jarrett | |
| 2005/0005958 | A1 * | 1/2005 | Connelly | 135/33.41 |
| 2005/0011134 | A1 * | 1/2005 | Boltan et al. | 52/3 |
| 2007/0095374 | A1 | 5/2007 | Gendriesch et al. | |
| 2007/0125409 | A1 * | 6/2007 | Cullen | 135/33.41 |
| 2007/0256717 | A1 * | 11/2007 | Stollar | 135/33.2 |
| 2007/0295379 | A1 | 12/2007 | Basta | |

(Continued)

FOREIGN PATENT DOCUMENTS

| | | |
|---|---|---|
| CN | 2221323 Y | 3/1996 |

(Continued)

*Primary Examiner* — Noah Chandler Hawk
(74) *Attorney, Agent, or Firm* — Fish & Associates, PC

(57) ABSTRACT

A canopy system for increasing the coverage of multiple umbrellas has been disclosed. The canopy system includes a canopy portion and at least one fastener for removeably attaching the canopy portion to a first and second umbrella. The fastener can attach to unmodified portions of an umbrella so that the canopy system may be used with existing umbrellas and umbrellas not especially manufactured to couple with a canopy. The canopy system may advantageously include a support structure for supporting the canopy portion in a desired shape. The length of the canopy system can be adjustable and the system can be easily collapsed for storage and portability.

14 Claims, 5 Drawing Sheets

U.S. PATENT DOCUMENTS

| | | | | |
|---|---|---|---|---|
| 2008/0099060 | A1* | 5/2008 | Stocking et al. | 135/115 |
| 2008/0163910 | A1 | 7/2008 | Hollinger | |
| 2009/0032078 | A1 | 2/2009 | Gardiner | |
| 2010/0089429 | A1 | 4/2010 | Yang | |
| 2010/0319738 | A1 | 12/2010 | Elder | |
| 2010/0326485 | A1 | 12/2010 | Li | |
| 2011/0023926 | A1 | 2/2011 | Bony | |

FOREIGN PATENT DOCUMENTS

| | | | |
|---|---|---|---|
| CN | 2269752 | Y | 12/1997 |
| CN | 1663497 | A | 9/2005 |
| CN | 2847936 | Y | 12/2006 |
| CN | 200941870 | Y | 9/2007 |
| CN | 201029507 | Y | 3/2008 |
| CN | 201171414 | Y | 12/2008 |
| CN | 201234641 | Y | 5/2009 |
| CN | 201299185 | Y | 9/2009 |
| GB | 2200044 | | 7/1988 |
| WO | 0226073 | | 4/2002 |
| WO | 2007027979 | A2 | 3/2007 |

* cited by examiner

FIG. 4
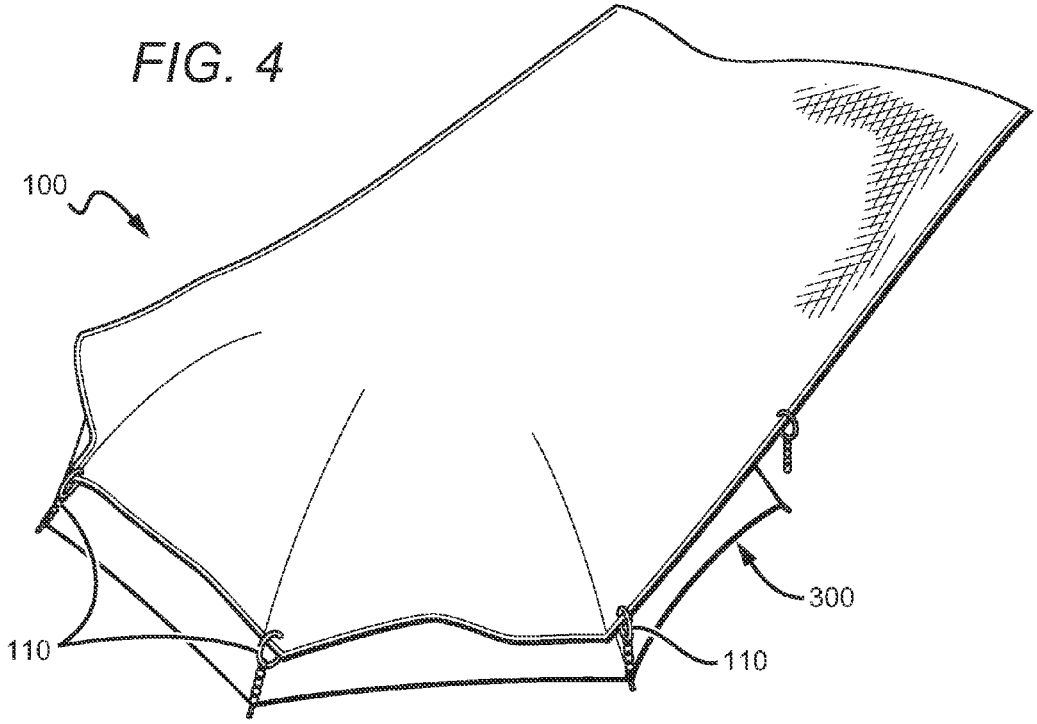
FIG. 5a
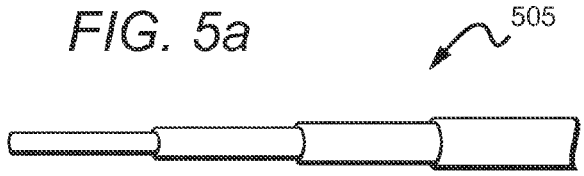
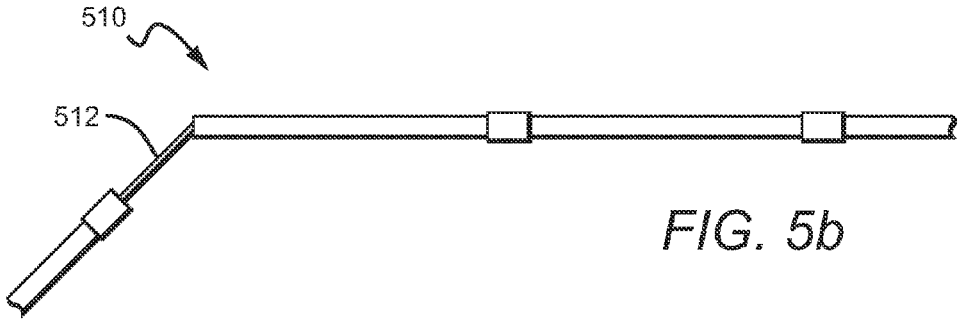
FIG. 5b

CANOPY FOR UMBRELLAS

This application claims priority to provisional application no. 61/324,674 filed Apr. 15, 2010.

FIELD OF THE INVENTION

The field of the invention is umbrellas and coverings.

BACKGROUND

Umbrellas have been used for centuries as a portable means for protecting a user from the sun and rain. A major problem with existing umbrellas is the limited coverage area, especially when multiple users are contemplated. Most umbrellas are too small for more than one person. While there are bigger umbrellas that provide coverage for two or maybe even three people, these umbrellas are usually heavy and bulky. In a situation where groups of people need coverage, such as children, the bigger umbrellas often fail to provide sufficient coverage. It would be advantageous to provide a portable means for covering large groups of people.

U.S. Pat. No. 7,121,289 to Anderson and U.S. Pat. No. 5,002,080 to Ma both describe umbrellas that can be expanded to accommodate multiple people. In Ma, the umbrella is expanded by separating the middle stem and handle into two separate stems and handles, which stretches the umbrella canopy and reveals a central flap portion. With the central flap portion exposed, the expanded umbrella provides double the coverage area than when the umbrella is retracted. In this manner, Ma provides an umbrella that can be used for one person, or alternatively, the umbrella can be expanded to accommodate several people. While Ma does provide a useful improvement on umbrellas and addresses the problem of covering multiple people, Ma suffers from several drawbacks: (i) the umbrella must be specially manufactured with unique features that allow for expanding and retracting, (ii) the umbrella coverage area is still fairly limited and can only comfortably accommodate two or three people, (iii) the central flap portion is permanently attached to the umbrella, making the umbrella unnecessarily heavy when used in a retracted mode for a single-person, and (iv) the umbrella is not capable of joining with a second distinct umbrella.

International Patent Application Publication WO 02/26073 to Yu discloses joining two umbrellas with a connecting fabric so that two people can walk together in close proximity while under their respective umbrellas. Each umbrella is especially manufactured with an expandable/retractable rib. When the umbrellas are used separately, the rib is expanded to have a length equal to the non-extendable ribs on the umbrellas. The two umbrellas can be joined by retracting the expandable/retractable ribs and attaching the connecting fabric. In this manner, two umbrella users can be close to each other while using their umbrellas. Although Yu contemplates joining two umbrellas, Yu fails to provide a connecting canopy that can comfortably accommodate more than two people. Moreover, Yu requires that the umbrellas be specifically manufactured with unique features, such as the extendable/retractable rib and hook and look fastener strips.

U.S. Pat. No. 7,101,000 to DeMars and CN201299185Y also contemplate joining two umbrellas with a connecting flap. However, like Yu, the connecting flap/canopy in DeMars and CN201299185Y are not configured to comfortably accommodate more than two people. Moreover, the umbrellas taught therein are specifically designed to mate with the connecting flap, thus preventing the connecting flap from being used with existing umbrellas.

International Publication Number WO 2007/027979 to D'Firo describes a canopy extension that can be attached to the normal features of an existing umbrella, thereby obviating the need for a customer to purchase a new umbrella. While D'Firo provides a useful invention for extending the coverage of existing umbrellas, D'Firo fails to contemplate that a canopy can be used to join two existing umbrellas. Moreover, the canopy extension contemplated in D'Firo must conform to the shape of the outer perimeter of the umbrella, thus preventing the canopy from being used with different sized umbrellas having different shaped perimeters. In sum, the prior art fails to disclose a canopy for connecting multiple existing umbrellas, wherein the canopy is completely removeable from the umbrellas and is sized and dimensioned to provide a coverage area large enough to comfortably accommodate multiple people.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

What has yet to be appreciated is that a canopy system for connecting two umbrellas can include fasteners that are configured to attach the canopy to unmodified portions of existing umbrellas. Thus, there is still a need for a methods and systems that join two or more existing umbrellas in order to provide greater coverage area.

SUMMARY OF THE INVENTION

The inventive subject matter provides apparatus, systems and methods in which a canopy having at least one fastener is configured to couple with a first and second umbrella. The fastener is configured to removeably attach to unmodified portions of the first and the second umbrellas, thus allowing the canopy to be used with existing umbrellas that are not specifically designed to receive canopy fasteners.

As used herein, "canopy" means an object that is configured to provide substantial coverage of a user. As used herein, "unmodified portions" of an umbrella means the portions are not especially manufactured to receive a fastener of a canopy system, and do not require any structural change or modification in order to receive the canopy fastener. Thus, extending the spokes of a typical umbrella in order to deploy and open up the umbrella would not be a "modification" (i.e. the spokes would be considered an "unmodified portion" of the umbrella), as long as the umbrella spokes were not especially designed and included within the umbrella for the purposes of receiving a connecting canopy fastener. On the other hand, a zipper on the umbrella would be a "modified portion" if it was especially included on the umbrella for the purposes of attaching a canopy. As used herein, "especially manufactured," "especially designed," and "especially included" means manufactured/designed/included for the intended purpose of attaching a canopy fastener.

The canopy can have an adjustable length, such as by including pleats that can be flattened out or folded up, allowing the user to select and control the amount of coverage provided by the canopy system. The canopy and fastener can also be configured to attach to a third umbrella, thus joining the third umbrella with the first and second umbrellas. The canopy preferably provides coverage for one person, more preferably three people, most preferably five people, not including the people holding the umbrellas. Alternatively, the canopy preferably provides at least one meter, more preferably two meters, most preferably three meters of distance between the first and second umbrellas. Furthermore, drapes such as those taught in U.S. Pat. No. 7,503,336 can be suitably adapted for use with the disclosed concepts taught herein, thus providing side coverage from sun and rain. Moreover, the width of the canopy can be chosen such that it is longer than the widths of both the first and second umbrellas, thus allowing the canopy to utilize the full width of the first and second umbrellas as a support for the canopy.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 4 is a perspective view of a canopy system attached to a first umbrella.

FIGS. 5*a*-5*f* show various embodiments of support structure for a canopy system.

DETAILED DESCRIPTION

Figure 1:
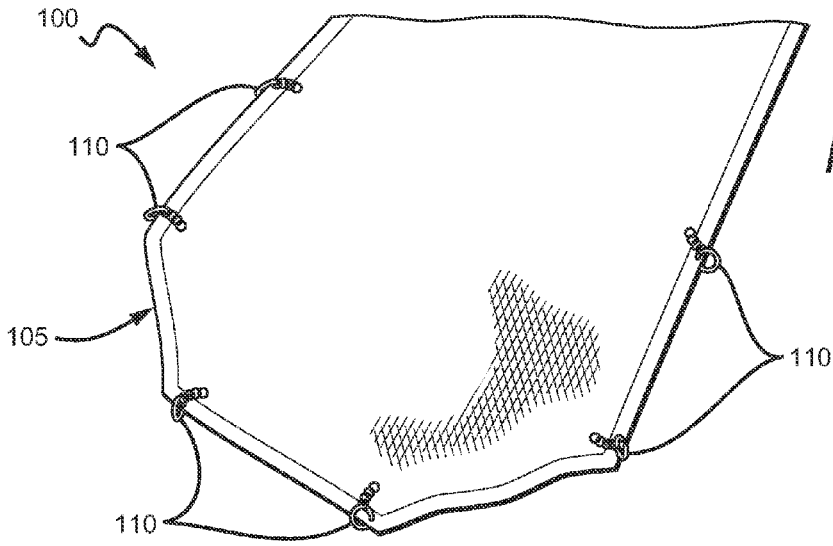
FIG. 1 shows a perspective view of one embodiment of a canopy system.

FIG. 1 shows a canopy system 100 having a canopy 105 and fasteners 110. Canopy 105 can be made of any commercially available material suitable for joining two umbrellas. Preferably, canopy 105 is made of a water resistant fabric and/or light reflective colors and materials in order to protect a user from rain or sun light. Canopy 105 can optionally include pleats, allowing canopy 105 to expand and retract in an accordion-like fashion. In this manner, the length of canopy 105 can be adjusted by bringing the umbrellas closer together or farther apart. Canopy 105 may also include a logo, advertisement, or decorative image. Canopy 105 is preferably made of a light weight material and can be folded or rolled up in order to facilitate portability and storage.

Canopy 105 can be sized and dimensioned such that it provides coverage for one person, in addition to the two people holding the umbrellas. More preferably, canopy 105 can be sized and dimensioned to provide coverage for many people, in addition to the two people holding the umbrellas. In one embodiment, canopy 105 is sized and dimensioned to provide coverage for a large group of elementary grade students.

Canopy 105 can also be configured to overlap with a substantial portion of a covering of an umbrella, thus providing a seamless coverage area. A "substantial portion" of a covering of an umbrella means at least half, more preferably two-thirds, most preferably all, of the umbrella covering's surface area is overlapped by the canopy.

Figure 2:
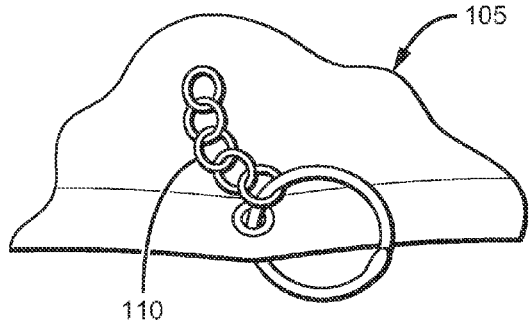
FIG. 2 is a close-up perspective view of one embodiment of a fastener of a canopy system.
Figure 3:
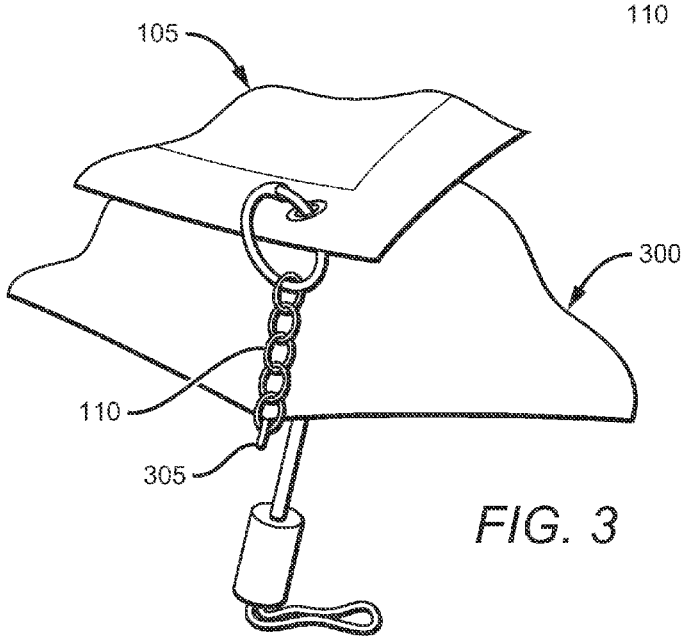
FIG. 3 is a close-up perspective view of a fastener attached to an unmodified portion of an umbrella.

FIG. 2 is a close-up of a fastener 110, which comprises a big ring and a chain of smaller rings. FIG. 3 is a close-up of fastener 110 attached to a spoke 305 of an umbrella 300. Spoke 305, also called a rib, is an elongated member included within umbrella 300 for the purpose of providing support to the covering of umbrella 300. Spoke 305 is an "unmodified portion" of umbrella 300, meaning spoke 305 was not especially manufactured and included within umbrella 300 for the purpose of attaching fasteners of a canopy system. Fastener 110 is configured to removeable attach to spoke 305 by looping one of the small rings around the end of spoke 305. The chain of rings allows fastener 110 to attach to different size umbrellas. For example, fastener 110 could attach to an umbrella with a smaller diameter than that of umbrella 300 by using a ring higher up on the chain. In an alternative embodiment, a fastener capable of attaching to different size umbrellas is provided by utilizing an elastic cord with one ring at the end.

Fastener 110 could also be configured to attach to an unmodified portion of umbrella 300 other than spoke 305. For example, fastener 110 could comprise a pin on canopy 105 that is configured to pierce an edge of the fabric of umbrella 300. In this manner, canopy 105 can be removeably attached to any existing umbrella having an edge made of a fabric. Thus, the canopy system advantageously functions with "existing umbrellas" (e.g. umbrellas already being sold on the market and/or not specifically manufactured to couple with a canopy system). Furthermore, the canopy system is capable of functioning with many different umbrella types and sizes. While fasteners 110 preferably attach to an unmodified portion of an umbrella, it is also contemplated that fasteners 110 could optionally be capable of coupling to modified portions of an umbrella. In this manner, a canopy system can be used with existing umbrellas that have no special features for attaching a canopy system, and also with especially manufactured umbrellas (e.g. umbrellas that have been especially manufactured with features for attaching a fastener of a canopy).

Fastener 110 could be any fastener suitable for removeably attaching canopy 105 to an unmodified portion of an existing umbrella, such as the edge of a covering of the umbrella, an end of a spoke of the umbrella, or a top protrusion of the umbrella. Removeable fasteners are well known and may include, but are not limited to, hook and loop fasteners, pins, buttons, adhesive-backed hook and loop fasteners, magnets, clamps, elastic cords, and combinations thereof. As used herein, "releaseable fastener" and "removeable fastener" means the fastener allows the canopy to be completely removed from the umbrella, even though a portion of the fastener remains on the umbrella. Thus, a hook and loop fastener with an adhesive backing that has been attached to an existing umbrella is a releaseable and removeable fastener, even though a component of the fastener remains attached to the umbrella after the canopy is removed.

Canopy 105 can include multiple fasteners, either integrated within the canopy, or removeably attached to the canopy. The fasteners can be of different kinds (e.g. magnets, pins, buttons, adhesives, hook and loop fasteners) and configurations in order to ensure that the canopy is capable of connecting with all kinds, varieties, configurations, and sizes of existing umbrellas. The fasteners can also be configured to attach to different unmodified portions on an umbrella.

FIG. 4 is a perspective view of canopy system 100 attached to umbrella 300 via fasteners 110. All of the fasteners 110 have been attached to ends of the spokes of umbrella 300, as shown and explained in FIG. 3. In this manner, canopy 100 remains attached to umbrella 300 during use, and can be easily detached when no longer needed. The opposite end of canopy 100 would also have fasteners for attaching that end to a second umbrella (not shown).

When the canopy is sized and dimensioned to provide coverage for multiple people, the canopy system can include support structure for maintaining a desired shape of the canopy. Examples of contemplated support structure include, but are not limited to, telescopic poles, hollow poles with an elastic inner cord, twistable metal wire, and fibers within the canopy fabric. FIGS. 5*a*-5*f* show various support structures that can be used with and/or included within a canopy system, as discussed below.

Telescopic poles, such as those taught in US Patent Application Publication No. 2005/0011134, can be suitably adapted for use with the disclosed concepts taught herein. FIG. 5*a* is a side view of a telescopic pole 505. When the canopy is not in use, pole 505 can be collapsed and stored. When the canopy system is being used, pole 505 can be coupled to the canopy system, either before or after the canopy system is attached to a plurality of umbrellas. Pole 505 can couple to a canopy via any suitable fastening means, such as by inserting the pole within a sleeve, pocket, or loop of the canopy, or by utilizing spring clamps, hook and loop fasteners, pins or other fasteners. Attachment methods and fasteners are not limited to the exact details of the construction and enumeration of the parts described above. Pole 505 can also attach to the umbrella itself, and preferably attaches to unmodified portions of both umbrellas, thus providing a support structure for the canopy that is capable of attaching to existing umbrellas and umbrellas not especially manufactured to attach with support structure of a canopy system.

FIG. 5*b* is a side view of a collapsible pole 510. Pole 510 comprises several short sections attached to one another with elastic cords 512. The ends of each section are configured to mate with each adjacent end, allowing pole 510 to be assembled in an extended fashion. When pole 510 is extended, it can be coupled with a canopy system in order to provide support and maintain a desired shape of the canopy. Pole 510 can be disassembled when the canopy system is stored away. It is also contemplated that pole 510 can attach to unmodified portions of a first and second umbrella. Furthermore, the mating ends of each section of pole 510 can be configured to lock with the adjacent section, thus allowing pole 510 to resist tensile forces.

Figure 5C:
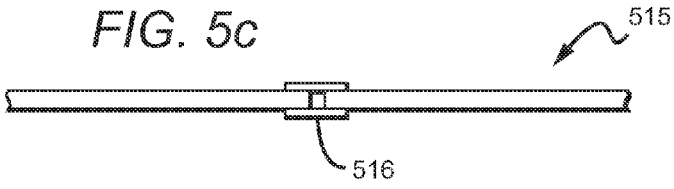
Figure 5D:
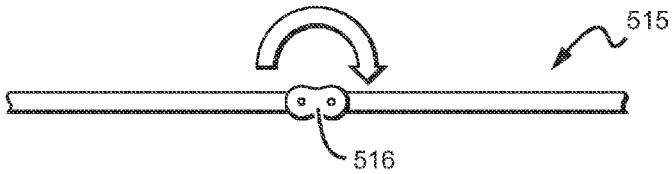

FIGS. 5*c* and 5*d* show top and side views, respectively, of a bendable pole 515. Pole 515 has hinge 516, which allows pole 515 to be folded up when not in use. Pole 515 preferably has a plurality of hinges, allowing pole 515 to be folded up into a short length for easy storage and portability. When pole 515 is unfolded and completely extended, pole 515 can be coupled with a canopy system and/or umbrellas, thus providing a support structure for attaching a canopy to the umbrellas, similar to poles 505 and 510.

Figure 5E:
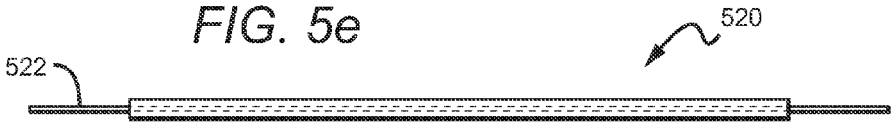
Figure 5F:
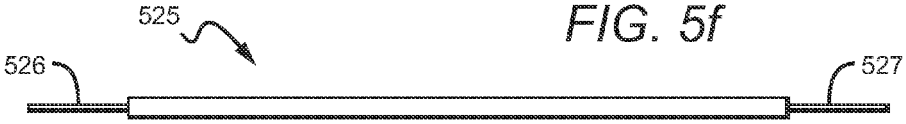

FIGS. 5*e* and 5*f* show poles 520 and 525 respectively. Pole 520 has an elastic cord 522 running through a hollow portion of pole 520, and can be used to attach pole 520 to an unmodified portion of an umbrella, such as a protrusion on top of the umbrella. Pole 525 is similar to pole 520, except that elastic cords 526 and 527 are attached to each end of pole 525 and do not run through a hollow portion of pole 525.

Support structures other than poles are contemplated. One example that could be suitably adapted for use with the disclosed concepts taught herein include US Patent Application Publication No. 2010/0089429 and U.S. Pat. No. 6,109,281, which disclose collapsible support structures (i.e. twistable metal wire) for a canopy. The twistable metal wire can be integrated within the canopy portion. The wire within the canopy provides support and helps maintain a desired shape, and further allows the canopy system to be folded up when not in use, similar to many common windshield reflectors and pop-up beach tents. Structural support can also be provided by using a rigid fabric in various sections throughout the canopy or by simply utilizing an elastic cord within sleeves of the canopy. In sum, the support structure can comprise any element suitable for aiding in maintaining a desired shape of the canopy, or otherwise improving the structural strength of the canopy system.

Figure 6:
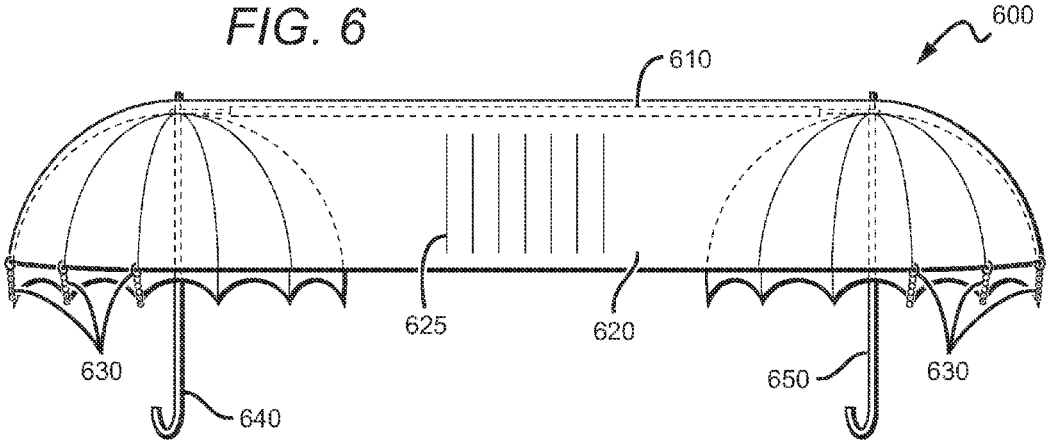
FIG. 6 is a side view of one embodiment of a canopy system attached to a first and second umbrella.

FIG. 6 shows a canopy system 600, comprising a pole 610, canopy 620, and various fasteners 630. Canopy system 600 is removeably attached to a first umbrella 640 and a second umbrella 650 via fasteners 630, in a similar fashion to fasteners 110 of FIG. 3. Pole 610 is provided to prevent canopy 620 from sagging or drooping downward in between the first umbrella 640 and second umbrella 650. Pole 610 attaches to an unmodified portion of first and second umbrellas 640 and 650, similar to pole 520 as discussed above. When canopy system 600 is removed from first and second umbrellas 640 and 650, canopy 620 can be folded and pole 610 can be collapsed for easy storage and portability. Canopy 620 also has pleats 625 for allowing the length of canopy 620 to be adjusted by expanding/flattening or folding/tightening the elastic pleated sections in an accordion-like fashion. Canopy 620 is preferably sized and dimensioned such that the coverings and support structure of the first and second umbrellas do not overlap or interfere with one another when joined by canopy 620.

Figure 7:
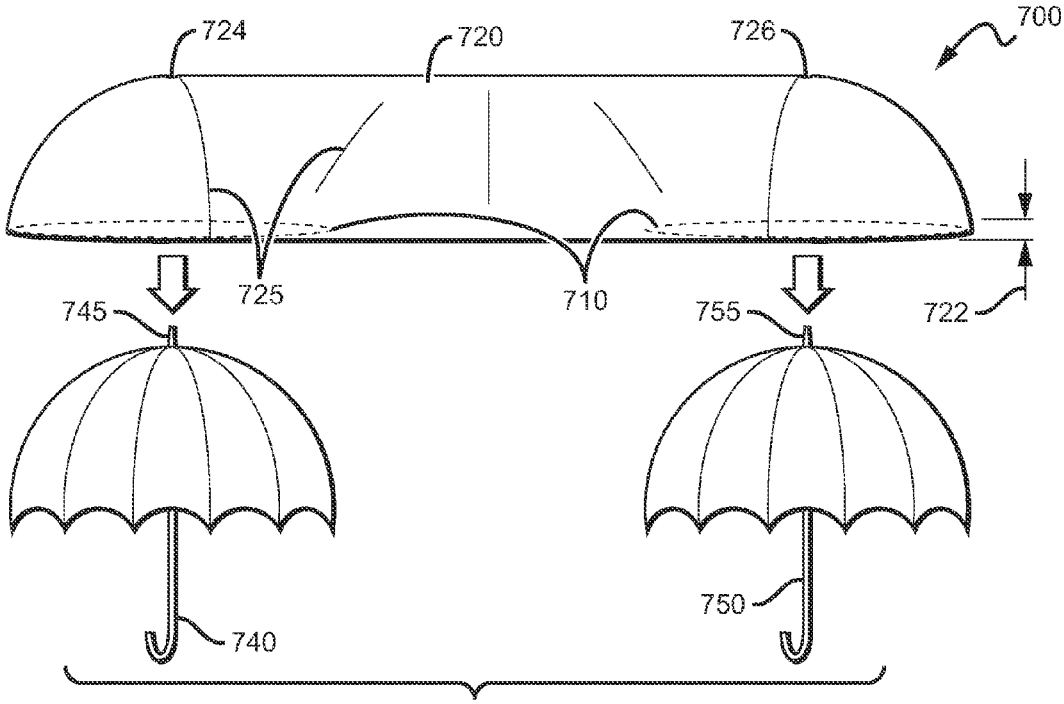
FIG. 7 is a side view of one embodiment of a canopy system attached to a first and second umbrella.

FIG. 7 shows a canopy system 700, comprising a canopy 720 having twistable wires 710. Canopy system 700 can couple with first and second umbrellas 740 and 750 by placing the wires 710 around the circumference of umbrellas 740 and 750. Canopy 720 has a width 722, which is sized and dimensioned to entirely overlap umbrellas 740 and 750, thus providing a "seamless" coverage area. Canopy 720 has holes 724 and 726 for receiving protrusions 745 and 755 of umbrellas 740 and 750, respectively. Canopy system 700 is releaseably fastened to the umbrellas by simply placing canopy system 700 over umbrellas 740 and 750. However, it is also contemplated that canopy system can optionally include fasteners for more securely fastening the canopy system 700 to umbrellas 740 and 750. Holes 724 and 726 can also be configured to include fasteners for removeably attaching canopy system 700 to umbrellas 740 and 750. Canopy 720 also has a plurality of channels and ridges 725 for channeling water away from the users. When canopy system 700 is not being used, canopy 720 can be folded and wires 710 can be folded or twisted, allowing for compact storage of canopy system 700.

Figure 8:
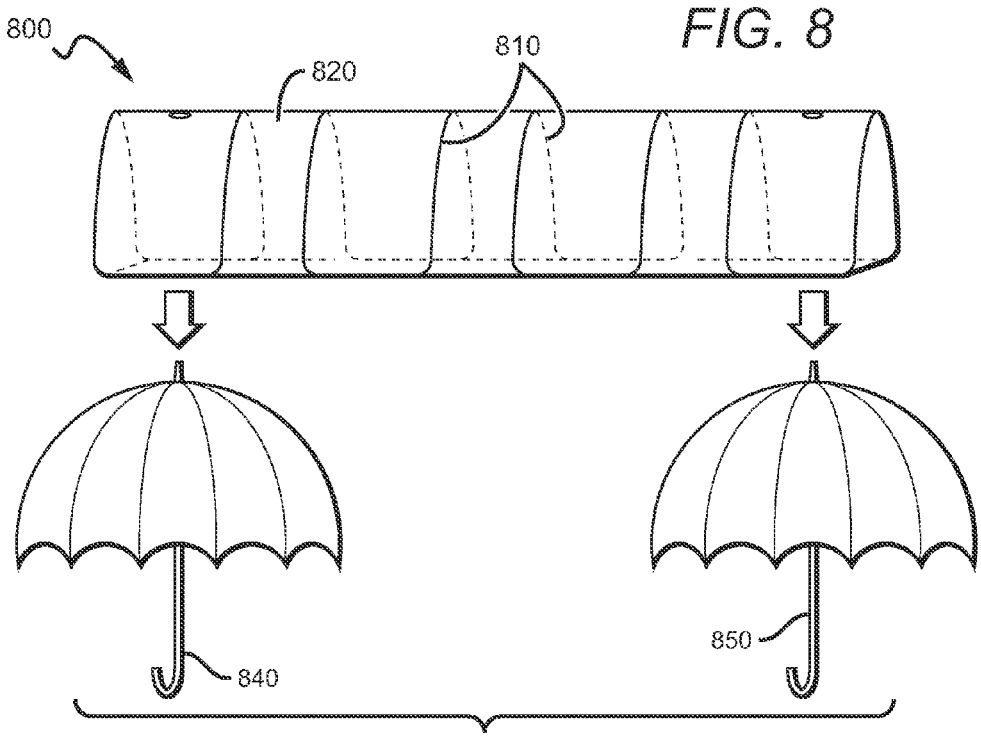
FIG. 8 is a side view of one embodiment of a canopy system attached to a first and second umbrella.
Figure 9:
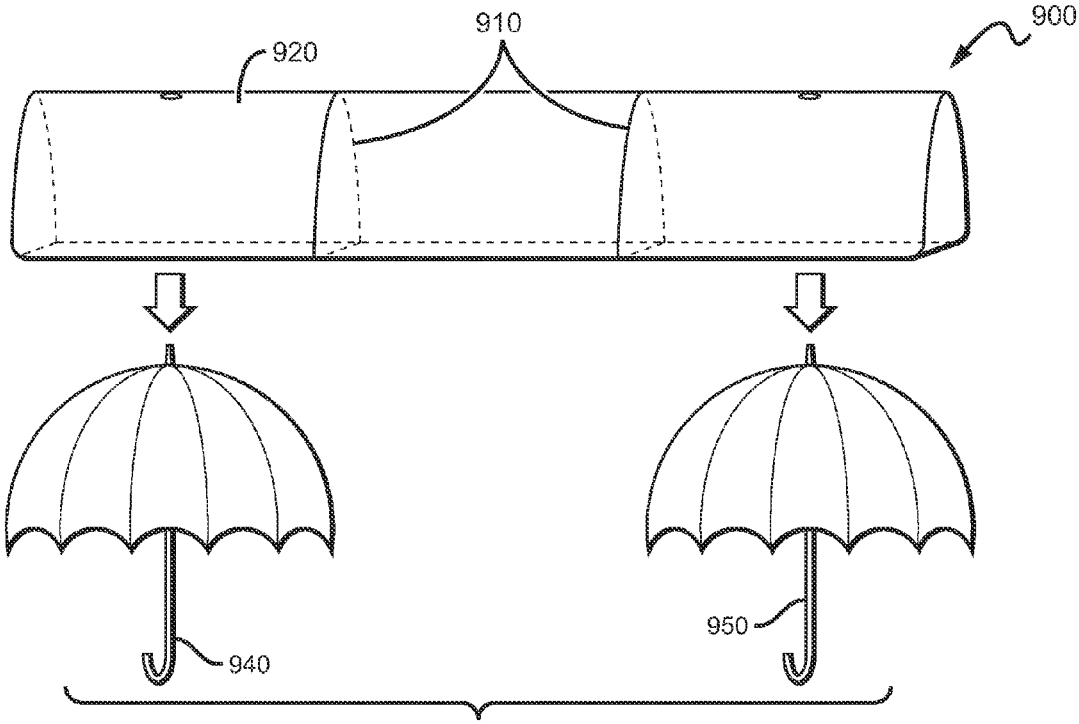
FIG. 9 is a side view of one embodiment of a canopy system attached to a first and second umbrella.

FIGS. 8 and 9 show other embodiments of canopy systems having a twistable metal wire as a support structure. In FIG. 8, canopy system 800 has a canopy 820 and twistable wire 810 comprising four loops. Canopy system 800 is configured to attach to umbrellas 840 and 850 by placing the canopy system 800 over the coverings of umbrellas 840 and 850. In FIG. 9, canopy system 900 has a canopy 920 and twistable wires 910. Wires 910 comprise four closed-loops shaped generally as half circles within canopy 920. Canopy system 900 is configured to removeably attach to umbrellas 940 and 950 in a fashion similar to canopy system 800. Thus, various shapes, orientations, and configurations of twistable and foldable wires within the canopy can be used to provide a foldable support structure for the canopy systems taught herein.

Figure 10:
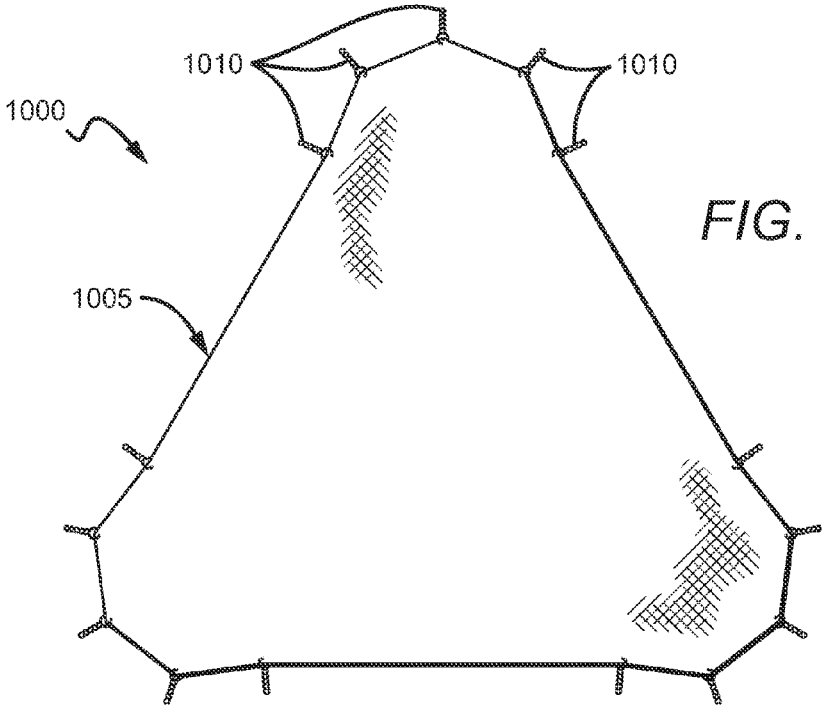
FIG. 10 is a top view of one embodiment of a canopy system for attaching a first, second, and third umbrella.

FIG. 10 shows a canopy system 1000, having a canopy 1005 and fasteners 1010. Canopy 1005 is shaped generally as a triangle. Each of the three corners of the triangle has fasteners 1010 for fastening canopy 1005 to unmodified portions of three separate and distinct umbrellas. Canopy 1000 is useful for joining three umbrellas together in order to create a very large coverage area. One of ordinary skill in the art will appreciate that many different shapes and configurations can be utilized in a manner consistent with the inventive concepts taught herein to join three umbrellas. For example, canopy 1005 can be shaped such that three umbrellas are joined in a linear fashion. One of ordinary skill will also appreciate that more than three umbrellas can be joined, in a manner consistent with the inventive concepts taught herein.

While the canopy systems taught herein are specifically contemplated to join two or more umbrellas, those skilled in the art will further appreciate that the inventive subject matter can be applied to structures other than umbrellas, such as coverings, canopies, beach tents, camping tents, awnings, and patio table umbrellas. It is also contemplated that a canopy system could be used to connect an umbrella to a fixed structure, such as an awning or wall. Furthermore, it is contemplate that a canopy system can be used to cover things other than people, such as pets, tables, perishable items, or other inanimate objects.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A canopy system comprising:

first and second independently usable umbrellas, each defining a coverage area thereunder;

a support pole removably attachable to the umbrellas and defining a distance therebetween;

a canopy configured to couple with the umbrellas and forming a coverage area thereunder that is larger than the sum of the coverage areas of the first and second umbrellas, wherein the canopy further comprises at least one fastener coupled with the canopy and configured to removably attach to unmodified portions of the first and second umbrellas, and a sleeve disposed on the canopy to removably receive the support pole.

2. The canopy system of claim 1, wherein the canopy has an adjustable length.

3. The canopy system of claim 1, wherein the canopy comprises a water resistant material.

4. The canopy system of claim 1, wherein the canopy comprises a light-reflective material.

5. The canopy system of claim 1, wherein the canopy comprises elastic pleats configured to tighten and flatten.

6. The canopy system of claim 1, wherein the canopy is configured to provide coverage for more than one person disposed between the first and second umbrellas.

7. The canopy system of claim 1, wherein the canopy is configured to overlap with a substantial portion of the first and second umbrellas.

8. The canopy system of claim 1, wherein the unmodified portion comprises an end of a spoke of an umbrella.

9. The canopy system of claim 1, wherein the unmodified portion comprises an edge of an umbrella covering.

10. The canopy system of claim 1, wherein the canopy is further configured to accommodate the first and second umbrellas in a manner where the first and second umbrellas are able to avoid interference with one another when fastened with the canopy.

11. The canopy system of claim 1, wherein the canopy includes at least one drape configured to provide side coverage.

12. The canopy system of claim 1, wherein the canopy is configured to provide at least one meter of coverage between the first and second umbrellas.

13. The canopy system of claim 1, wherein the canopy has a width greater than a width of the first umbrella and a width of the second umbrella.

14. The canopy system of claim 1, wherein the first and second umbrellas have varied configurations and sizes.

* * * * *